US006957971B2

(12) United States Patent
Wu

(10) Patent No.: US 6,957,971 B2
(45) Date of Patent: Oct. 25, 2005

(54) MULTIPLEX WIRE CONNECTOR UNIT

(76) Inventor: Jeng-shyong Wu, No. 14, Alley 1, Lane 326, Shin-Pin Road, Hsinchu (TW)

( * ) Notice: Subject to any disclaimer, the term of this patent is extended or adjusted under 35 U.S.C. 154(b) by 0 days.

(21) Appl. No.: 10/680,501

(22) Filed: Oct. 7, 2003

(65) Prior Publication Data

US 2005/0075000 A1 Apr. 7, 2005

(51) Int. Cl.[7] ..... H01R 13/40
(52) U.S. Cl. ..... 439/320; 439/680
(58) Field of Search ..... 439/320–322, 439/274–275, 752, 680, 587, 589, 310

(56) References Cited

U.S. PATENT DOCUMENTS 3,029,407 A * 4/1962 Burton et al. ..... 439/589
3,445,805 A * 5/1969 McLoad ..... 439/321
3,576,517 A * 4/1971 Johnson et al. ..... 439/321
3,789,346 A * 1/1974 De Brick ..... 439/320
4,229,064 A * 10/1980 Vetter et al. ..... 439/680

* cited by examiner

*Primary Examiner*—Tho D. Ta
*Assistant Examiner*—Felix O. Figueroa
(74) *Attorney, Agent, or Firm*—McGlew and Tuttle, P.C.

(57) ABSTRACT

Disclosed herein is a multiplex wire connector unit made of a male connector, a female connector, and a screw collar for providing connections for a plurality of wires, wherein the male connector further includes a male connector terminal, a collar journal, a sealed sleeve, and a male terminal block; the female connector further includes a female connector terminal, a collar journal, a sealed envelope, and a female terminal block; after connecting with the plurality of wires respectively, the male and the female connectors are coupled together in a unit using the screwed collar.

8 Claims, 7 Drawing Sheets

MULTIPLEX WIRE CONNECTOR UNIT

BACKGROUND OF THE INVENTION

1. Field of the Invention

The present invention relates to a multiplex wire connector unit, and more particularly, to a multiplex wire connector unit composed of a male connector part, a female connector part and a screwed collar. The male connector part and the female connector part can be respectively coupled with a plurality of wires, and then the two parts are engaged firmly together with the screwed collar to form a handy watertight multiplex water connector unit.

2. Description of the Prior Art

The wire connector is for connecting and fixing electrical conductors so as to conduct the electrical current in the circuit. It is often experiences that the electrical appliances or electronic devices fail to work normally due to improper connection or installation of the conductors. In order to prevent the possible hazard arising therefrom such as an overload or even a short circuit, a prompt response must be taken to clear above-mentioned improper connection or installation of the conductors, which usually calls for extra cost, time, and manpower.

A conventional wire connector unit is shown in FIGS. 1 and 2. A connector unit 10 is composed of a receiving portion 11 and a corresponding mating portion 12 to be coupled with. Both receiving portion 11 and mating portion 12 to be coupled with. Both receiving portion 11 and mating portion 12 are enclosed with an insulation cap 13 respectively in which includes a receiving side wire connector 14 and a mating side wire connector 15 respectively. One of the insulation caps 13 has a male coupler 131 at its one end, and the other insulation cap 13 has a female coupler 132 at its one end facing against the male coupler 131 to couple with each other. A set screw 16 is passing through the insulation caps 13 and die two connector 14 and 15 to combine them together. The insulation caps 13 and the two connectors 14, 15 are detachable when a wire 20 is to be installed. At the receiving portion 11, a detention member 17 associated with a guide slot 171 is provided to one end of the receiving side wire connector 14, one the other hand, at the mating portion 12, an adapter slot 18 associated with a protrusion 181 is provided at one end of the mating side wire connector 15 such that the detention member 17 can be mated with the adaptor slot 18.

As can be understood from the above description, the conventional wire connector unit constructed as such seems rather sophisticate. Using fixing screws and the set screw for construction is by no means a good way to attain the purpose of quick assembly or diassembly. Besides, it cannot provide means for connecting for connecting a plurality of wires in one connector that greatly reduces its practicability.

Aiming at the aforesaid shortcomings, the present invention is to propose a newly developed construction of multiplex wire connector unit, usable more efficiently, and conveniently than any conventional product.

SUMMARY OF THE INVENTION

It is an object of the present invention to provide a multiplex wire connector unit, which has several layered protection to achieve reliable water tight effect.

The multiplex wire connector unit of the present invention is essentially composed of a male connector, a female connector, and a screwed collar. The male connector further includes a male connector terminal, a collar journal, a sealed sleeve, and a male terminal block. The female connector further includes a female connector terminal, a collar journal, a sealed envelope, and a female terminal block. After connecting with a plurality of wires respectively, the male and female connectors are coupled together using the screw collars thereby forming a multiplex wire connector unit attached with a plurality of wires.

The multiplex wire connector unit of the present invention is characterized in its promptness and conveniency in assembly and disassembly.

In the present invention, a detention surface is provided for both mating surfaces of the male and the female connectors such that an undesirable looseness of components in the connector unit never occur and a reliable wire connection can be assured.

The objects and advantages of the invention may become more apparent by describing in detail the preferred embodiment of the present invention with reference to the attached drawings.

DETAILED DESCRIPTION OF THE PREFERRED EMBODIMENTS

Figure 1:
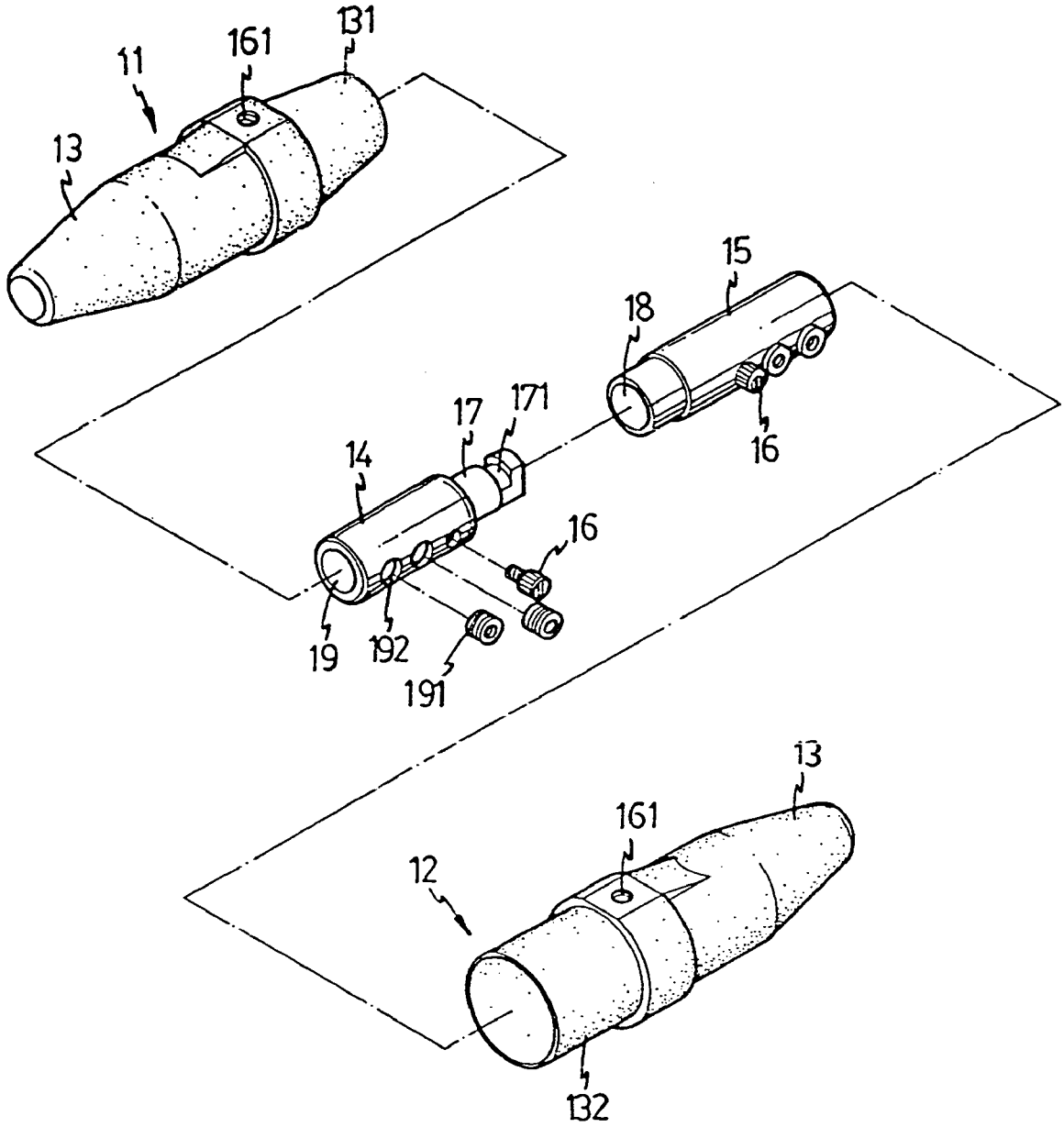
FIG. 1 Prior art
FIG. 1 is a three-dimensional exploded view of a conventional wire connector.
Figure 2:
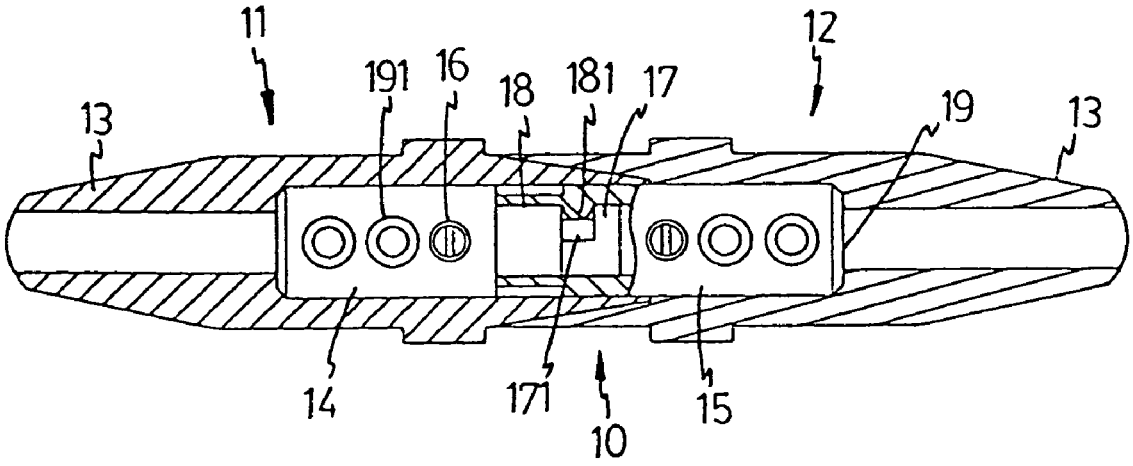
FIG. 2 Prior art
FIG. 2 is a cross-sectional view of an assembled conventional wire connector.
Figure 3:
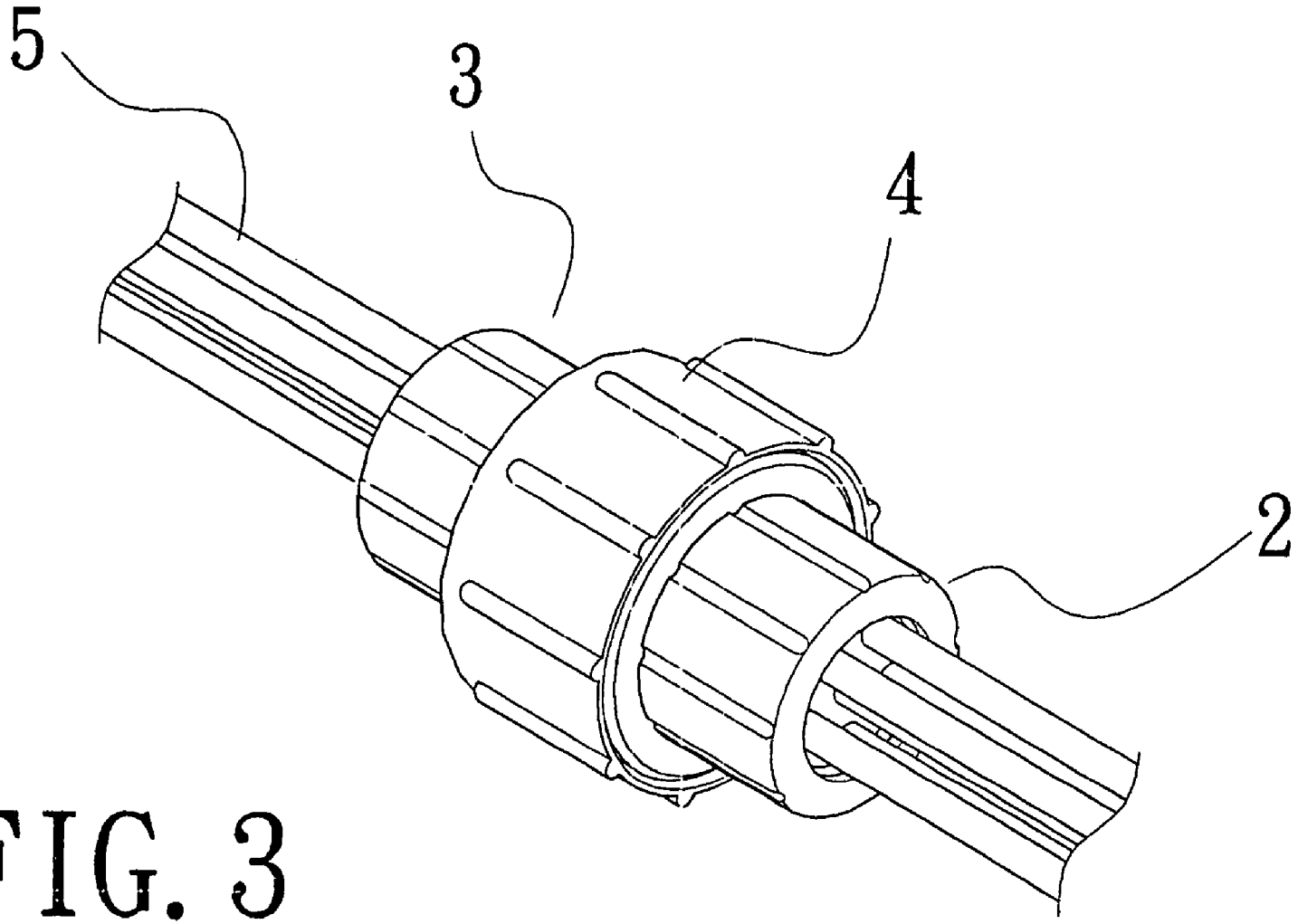
FIG. 3 is a three-dimensional assembly view of the present invention.

Referring to FIG. 3, the multiplex wire connector unit of the present invention is essentially composed of a male connector 2, a female connector 3, and a screwed collar 4, for allowing connection of a plurality of wires 5.

Figure 4:
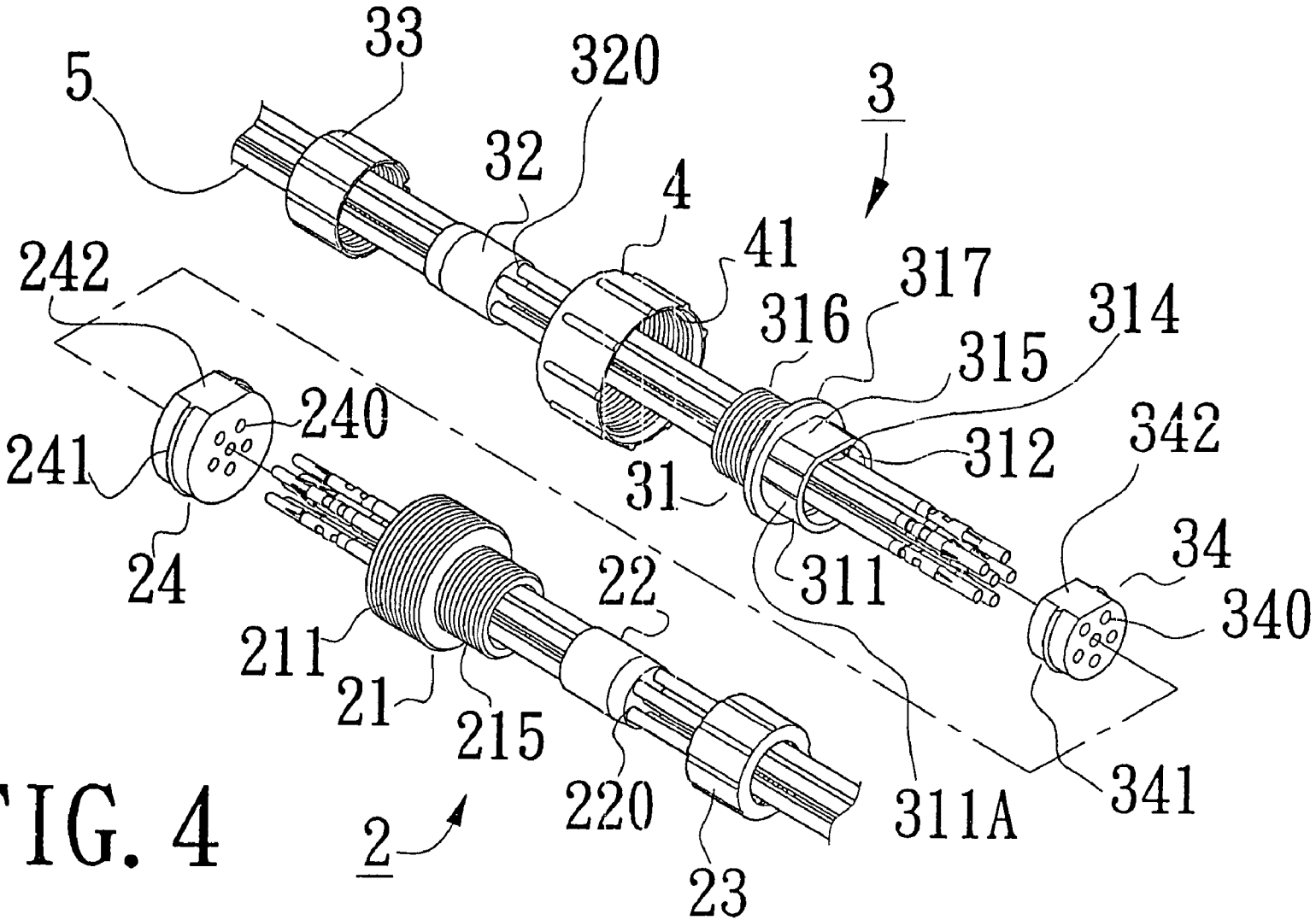
FIG. 4 is a three-dimensional exploded view of the present invention.
Figure 5:
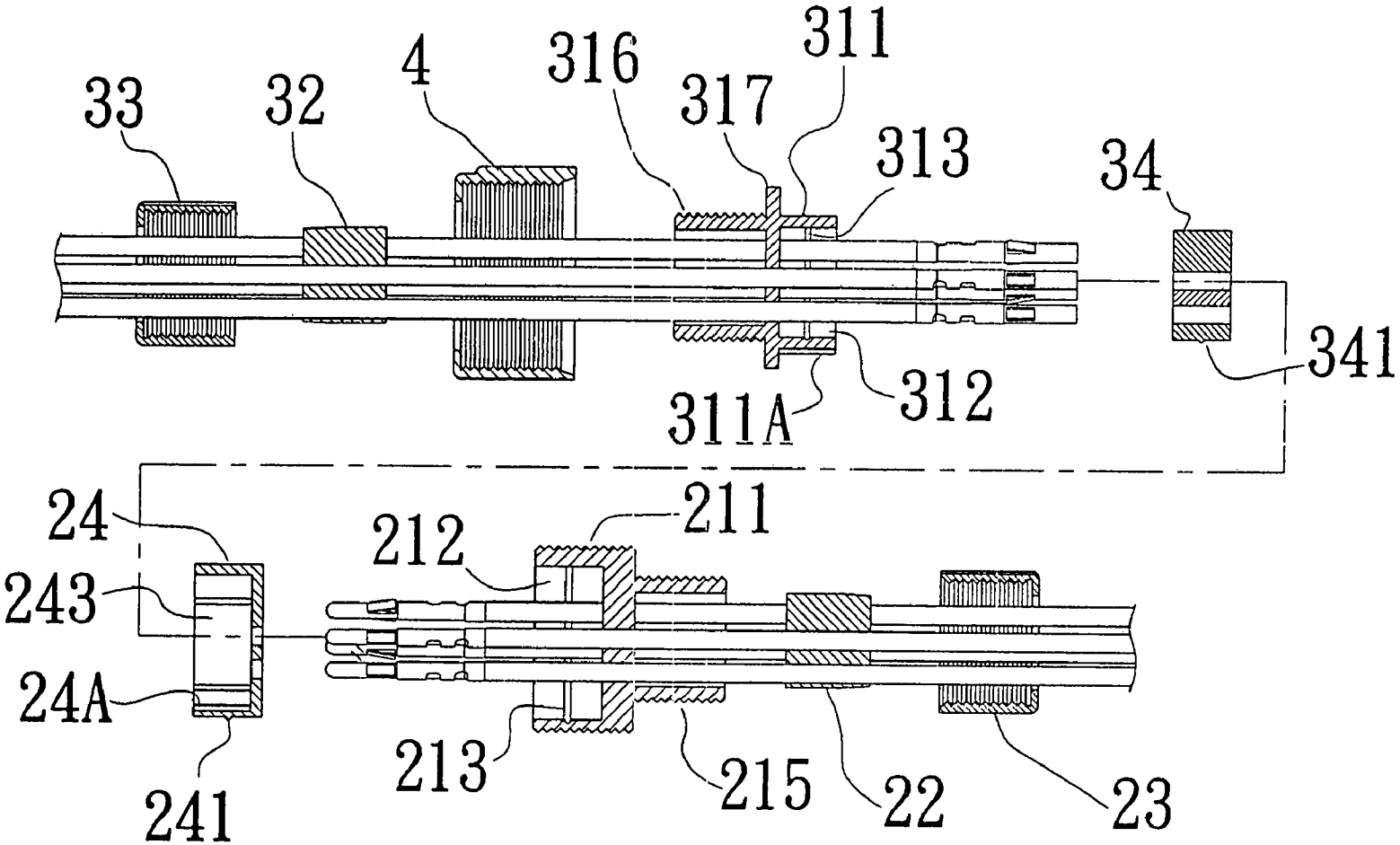
FIG. 5 is a longitudinal cross-sectional view of the present invention.

Referring to FIGS. 4 and 5, the male connector 2 further includes a male connector terminal 21, a collar journal 22, a sealed sleeve 23, and a male terminal block 24. The male connector terminal 21 is interposed between a front end solenoidal member 211, which is/means a member having a retaining physical property such as an outer thread of larger diameter and a rear end solenoidal member 215, which is/means a member having a retaining physical property such as an outer thread of smaller diameter. The front end solenoidal member 211 has an inner receiving cavity 212 (see FIG. 5) in which a male terminal block 24 having a plurality of via holes 240, is accommodated. The receiving cavity 212 has an inner detention groove 213 and a detention surface for trammeling a corresponding plug 241 and a detention surface 242 of the male terminal block 24 thereat and preventing the block 24 to rotate. The male terminal block 24 also has an inner receiving cavity 243 (see FIG. 5) with a detention surface formed at its one end. A collar journal 22 having a plurality of via holes 220 is plugged into the rear end solenoidal member 215, and an inner threaded sealed sleeve 23 further sleeves over and screw engages with the collar journal 22 thereby the wire 5 passing through the wire 5 passing through the via holes are tightly fixed.

The female connector 3 further includes a female connector terminal 31, a collar journal 32, a sealed envelope 33, and a female terminal block 34. The female connector terminal 31 has a configuration of a through sleeve with a clamping terminal 311 formed at its front end. The clamping terminal 311 has an inner receiving cavity 312 for accommodating a female terminal block 34 having a plurality of via holes 340. A detention groove 313 and a detention surface 314 are formed in the receiving cavity 312 for allowing the female terminal block 34 to mate with its corresponding plug 311 and detention surface 342, thereby fixedly positioning the female terminal block 34 thereat without loosely rotating. Furthermore, the clamping terminal 311 also has a detention surface 315 formed on its outer surface so as to couple firmly each other with the detention surface of the male terminal block 24, after the clamping terminal 311 is tucked into the receiving, cavity 243 of the male terminal block 24 thereby the male and female connectors 2 and 3 are firmly assembled. Besides, at least a stud tenon 311A is provided at the side portion of the clamping terminal 311 to be mated with corresponding slot mortise 24A formed in the male terminal block 24 so as to provide a tenon and mortise joint as a discrimination means for refusing incompatible mating of a male connector with a female connector.

The female connector terminal 31 has a rear end solenoidal member 316 for allowing a collar journal 32 having a plurality of via holes 320 to fit in, and then an internally threaded sealed sleeve 33 is sleeved over the collar journal 32 and mutually screw combined thereby the wires 5 passing through the via holes are tightly fixed. Besides, a disc type barrier 317 with a larger diameter is interposed between the front end clamping terminal 311 and the rear end solenoidal member 316.

Meanwhile, the screwed collar 4, which is provided at one end of the female connector 3, has a plurality of via holes for multiplex wires 5 to pass though. The screwed collar 4 encompasses the female connector terminal 31 and combines with the front end solenoidal member 211 of the male connector terminal 21 with its inner threads 41 thereby the male and the female connectors 2 and 3 are firmly screw engaged.

Figure 6:
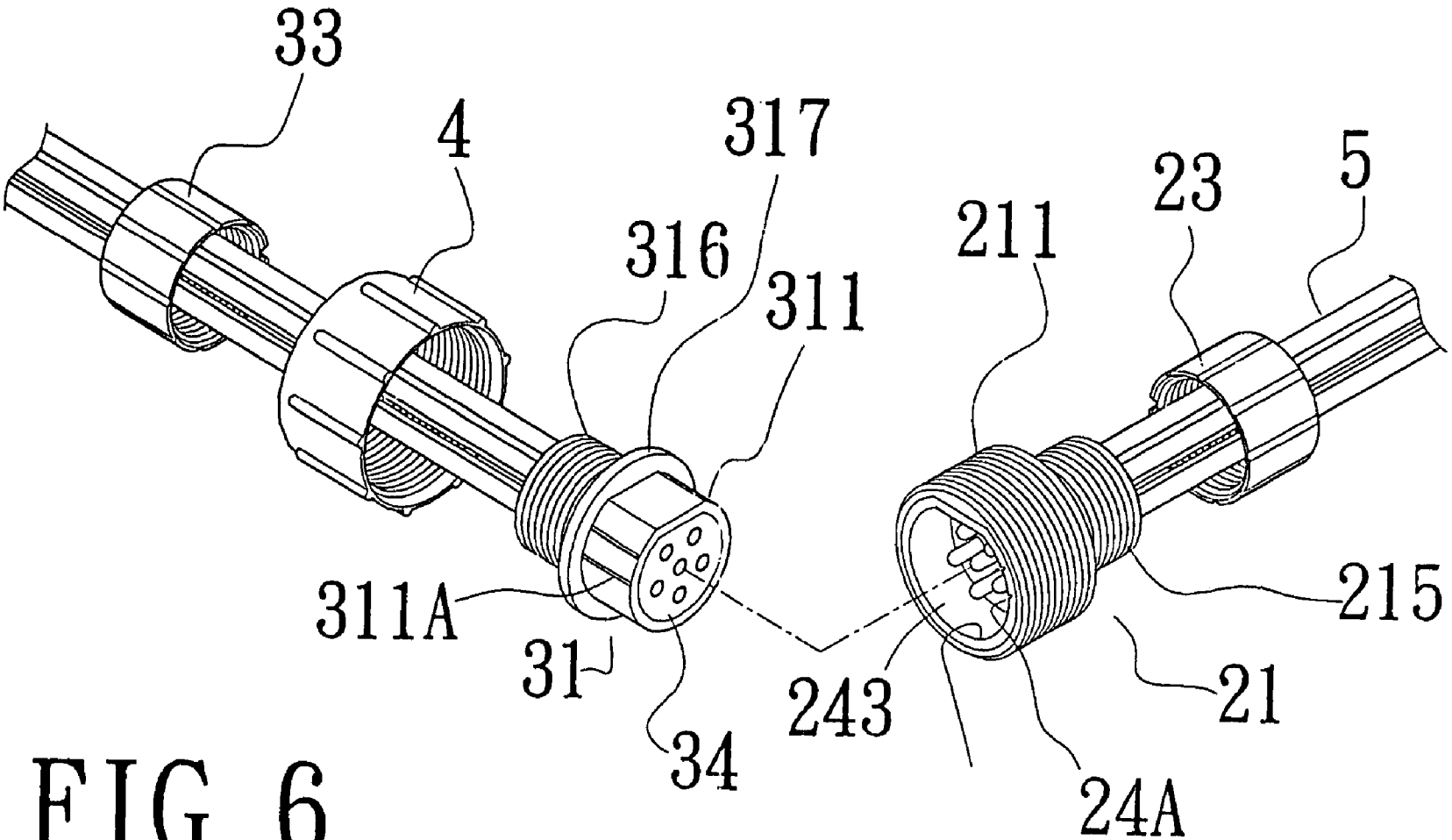
FIG. 6 is a partial perspect view of the present invention.
Figure 7:
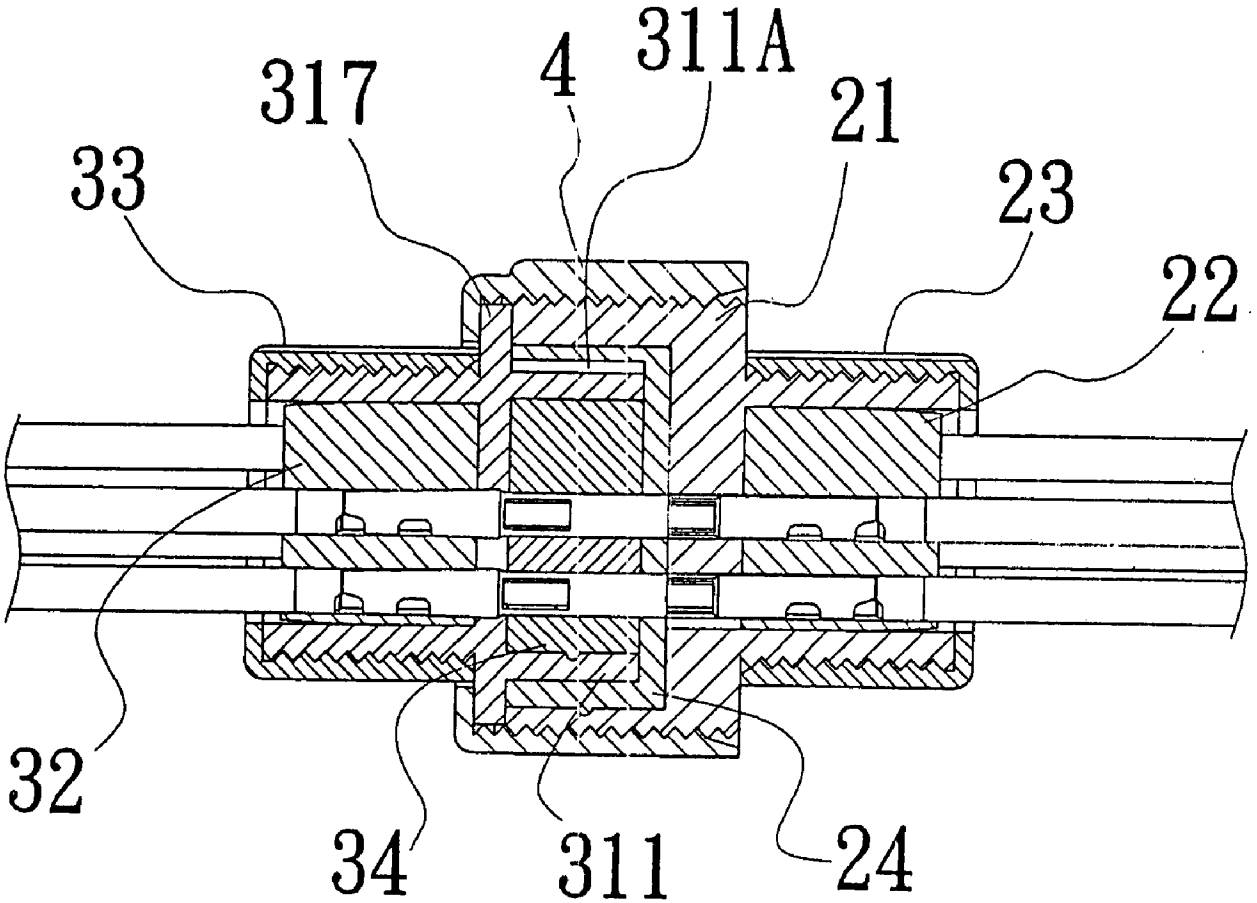
FIG. 7 is a longitudinal cross-sectional view of the wholly assembled multiplex wire connector unit according to the present invention.

For understanding how to assemble the multiplex wire connector unit with a plurality of wires, reference should be made to FIGS. 6 and 7. At first, passing the wires 5 through the male and the female connectors 2 and 3. Then combining the male side orderly beginning from the male connector 2, the collar journal 22, the sealed sleeve 23, and to the male terminal block 24. Next, combining the female side orderly beginning from the female connector 3, the female connector terminal 31, the collar journal 32, the sealed sleeve 33, and to the female terminal block 34, thus completing the conjoining of the male and female connections. Next, allowing male terminals 51 of the wires 5 to merge out of the receiving cavity 243, on the other hand, passing female terminals of the wire 5 through the via holes of the female terminal block 34. Afterwards, tucking the female terminal block 34 into the receiving cavity 243 so as to complete mating of the male and the female terminals of the wires, then, by screwing the screwed collar 4, the assembly of the whole multiplex wire connector unit is therefore finished.

The stud tenon 311 A provided at the side portion of the clamping terminal 311 associated with the corresponding slot mortise 24A formed in the male terminal block 24 can provide a tenon and mortise joint as a discrimination means for refusing incompatible mating of male and female connectors. Of course, the number, size and position of the tenon and mortise joint can be varied to acquire desirous discrimination means so as to assure secure and reliable application of the connector of the present invention.

From the above description, the multiplex wire connector unit according to the present invention has several noteworthy advantages which never be obtained from any conventional connector unit. The male and female connector are tightly coupled with the screwed collar after they are individually assembled. The connector unit constructed as Such ensures reliable water tightness fro multi-layered enclosures. The provision of the detention surface is its prominent characteristic in perfect prevention of loosening components after assembly.

Those who are skilled in the art will readily perceive how to modify the invention. Therefore, the appended claims are to be construed to cover all equivalent structures which fall within the true scope and spirit of the invention.

What is claimed is:

1. A multiple wire connector unit essentially comprising:

a male connector, a female connector, and a screwed collar for providing connection means for a plurality of wires;

wherein said male connector further includes a male connector terminal radially securing said plurality of wires, a collar journal radially securing said plurality of wires at a distance away from said male connector terminal, a sealed sleeve, and a male terminal block;

said female connector further includes a female connector terminal, a collar journal, a sealed envelop, and a female terminal block;

after connecting with said plurality of wires respectively, said male and said female connectors are coupled together in a unit using said screwed collar, wherein said male connector terminal is interposed between a front end solenoidal member of larger diameter and a rear end solenoidal member of smaller diameter, said front end solenoidal member has an inner receiving cavity in which said male terminal block having a plurality of via holes is accommodated, said rear end solenoidal member is for accepting said collar journal having a plurality of via holes to plug into, and said sealed sleeve having inner threads further sleeves over and engages with said rear end solenoidal member with screw threads thereby completing assembly and said receiving cavity of a front end solenoidal member at said male connector terminal has an inner detention groove and a detention surface, while said male terminal block also has a corresponding plug and a detention surface so as to trammel with each other without rotation.

2. The connector unit of claim 1, wherein said screwed collar is provided at one end of said female connector and has a hole for said multiplex wires to pass through, said screwed collar encompasses said female connector terminal and combines with said front end solenoidal member of said male connector terminal with its inner threads thereby said male and said female connectors are firmly screw engaged.

3. A multiple wire connector unit essentially comprising:

a male connector, a female connector, and a screwed collar for providing connection means for a plurality of wires;

wherein said male connector further includes a male connector terminal radially securing said plurality of wires, a collar journal radially securing said plurality of wires at a distance away from said male connector terminal, a sealed sleeve, and a male terminal block;

said female connector further includes a female connector terminal, a collar journal, a sealed envelop, and a female terminal block;

after connecting with said plurality of wires respectively, said male and said female connectors are coupled together in a unit using said screwed collar, wherein said female connector terminal is configurated into a through sleeve body with a clamping terminal formed at a front end, said clamping terminal is provided with an inner receiving cavity for accommodating said female terminal block having a plurality of via holes, said female connector terminal has a rear end solenoidal member for receiving the collar journal having a plurality of via holes to fit in, and then said sealed envelop having internal threads is sleeved over said rear end solenoidal member and mutually screw combined and said receiving cavity in a clamping end of said female connector terminal has an inner detention groove and a detention surface, while said female terminal block also has a corresponding plug and a detention surface so as to trammel with each other without rotation.

4. The connector unit of claim 3, wherein a disc type barrier with a larger diameter is interposed between said front end clamping terminal and said rear end solenoidal member.

5. The connector unit of claim 3, wherein said clamping terminal of said female connector terminal has a detention surface formed on its outer surface so as to couple firmly each other with the detention surface formed in the receiving cavity of said male terminal block.

6. The connector unit of claim 3, wherein at least one stud tenon is provided at the side portion of said clamping terminal of said female connector to be mated with corresponding slot mortise formed in said terminal block so as to provide a tenon and mortise joint as a discrimination means for refusing incompatible mating of male and female connectors.

7. A multiple wire connector unit essentially comprising:

a male connector, a female connector, and a screwed collar for providing connection means for a plurality of wires; wherein said male connector further includes a male connector terminal radially securing said plurality of wires, a collar journal radially securing said plurality of wires at a distance away from said male connector terminal, a sealed sleeve, and a male terminal block; said female connector further includes a female connector terminal, a collar journal, a sealed envelop, and a female terminal block; after connecting with said plurality of wires respectively, said male and said female connectors are coupled together in a unit using said screwed collar, wherein at least one stud tenon is provided at the side portion of said female connector terminal of said female connector to be mated with corresponding slot mortise formed in said male terminal block so as to provide a tenon and mortise joint as a discrimination means for refusing incompatible mating of male and female connectors.

8. The connector unit of claim 7, wherein the number, size, and position of said stud tenon and said slot mortise can be varied according to the actual requirement so as to obtain the variety of discrimination means.

* * * * *